US007811214B1

(12) United States Patent
Danowski

(10) Patent No.: US 7,811,214 B1
(45) Date of Patent: Oct. 12, 2010

(54) RESISTANCE TRAINING EXERCISE APPARATUS WITH POPPET LOAD SYSTEM

(75) Inventor: Thomas J. Danowski, Schaumburg, IL (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 12/362,810

(22) Filed: Jan. 30, 2009

(51) Int. Cl.
*A63B 21/008* (2006.01)

(52) U.S. Cl. ..... 482/113; 482/111

(58) Field of Classification Search ..... 482/5, 482/58, 89, 73, 111–113
See application file for complete search history.

(56) References Cited

U.S. PATENT DOCUMENTS 1,707,449 A * 4/1929 Rodale ..... 482/112
2,307,949 A * 1/1943 Phillips ..... 137/498
3,359,802 A * 12/1967 Sollenberger ..... 482/112
3,912,265 A * 10/1975 Muir ..... 482/113
3,955,655 A * 5/1976 Pornin ..... 188/313
4,290,599 A * 9/1981 Berger ..... 482/112
4,448,412 A * 5/1984 Brentham ..... 482/112
4,478,412 A * 10/1984 Muir ..... 482/113
4,772,016 A * 9/1988 Manion ..... 482/112
4,854,574 A 8/1989 Larson et al.
4,981,199 A * 1/1991 Tsai ..... 188/312
5,044,631 A 9/1991 Jones
5,114,389 A * 5/1992 Brentham ..... 482/53
5,190,511 A * 3/1993 Petree ..... 482/112

* cited by examiner

*Primary Examiner*—Loan Thanh
*Assistant Examiner*—Allana Lewin
(74) *Attorney, Agent, or Firm*—Andrus, Sceales, Starke & Sawall, LLP

(57) ABSTRACT

Resistance training exercise apparatus includes a poppet load system. During movement of a user-engaged exercise member in a first exercise direction, fluid flows past an open poppet in a first flow direction between housing chambers. During movement of the user-engaged exercise member in a second exercise direction, fluid flow between the chambers is blocked by a closed poppet, and instead fluid flows through an auxiliary passage through a one-way valve. Ballistic training is enabled with the addition of a second auxiliary fluid passage, second one-way valve, and a release valve.

7 Claims, 10 Drawing Sheets

RESISTANCE TRAINING EXERCISE APPARATUS WITH POPPET LOAD SYSTEM

BACKGROUND AND SUMMARY

The invention relates to resistance training exercise apparatus.

Various types of resistance training exercise apparatus are known in the prior art. The invention arose during development efforts directed toward a type of weight training known as ballistic training, though the invention is not limited thereto. An athlete working on an inclined chest press, for example, would like the ability to shove or throw a weight as far as he/she can and then let go of the handle. The system would then have to catch the weight on the way back in a safe and controllable manner. A method of measuring of how far the weight had traveled would be of value to the athlete or trainer as an indication of progress.

The present invention addresses the above need and further generically provides desirable resistance training exercise apparatus including a load system for providing the resistance. The invention has broad application to resistance training exercise apparatus including for ballistic training.

DETAILED DESCRIPTION

Figure 1:
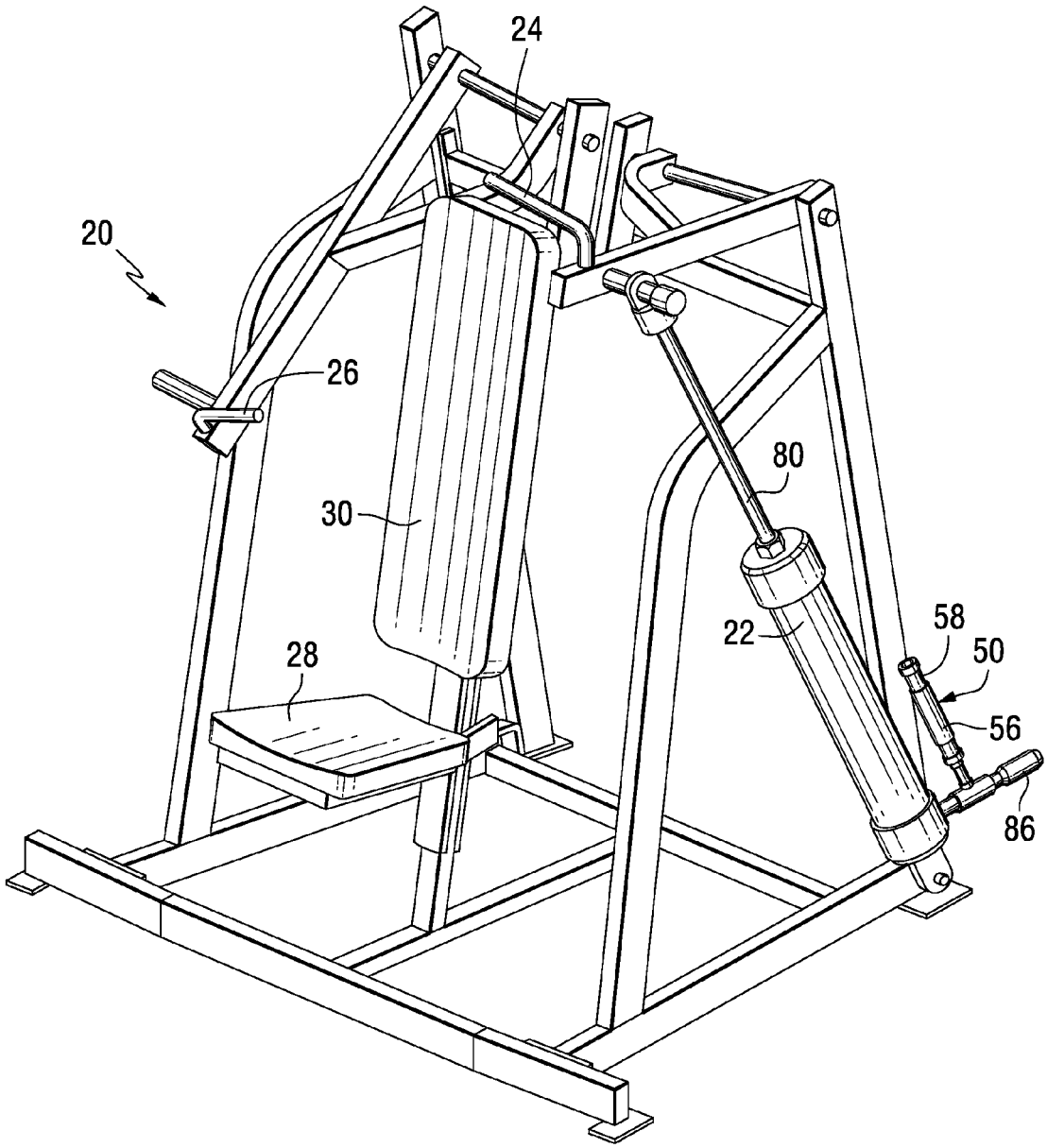
FIG. 1 is a perspective view of resistance training exercise apparatus in accordance with the invention.

FIG. 1 shows resistance training exercise apparatus such as a seated chest press 20, for example for which further reference may be had to U.S. Pat. No. 5,044,631, incorporated herein by reference. A load system, such as weights, or in the preferred embodiment of the present system an air cylinder 22, provides resistance resisting upward and outward movement of one or more user-engaged exercise members such as 24, 26, e.g. handles engaged by the athlete user's hands when in a seated position on seat 28 with his/her back resting against back rest 30, which handles 24, 26 are connected by suitable arm linkages to the load system, all as is known. The handles may move in unison, or in alternating opposite directions as shown in FIG. 1.

Figure 2:
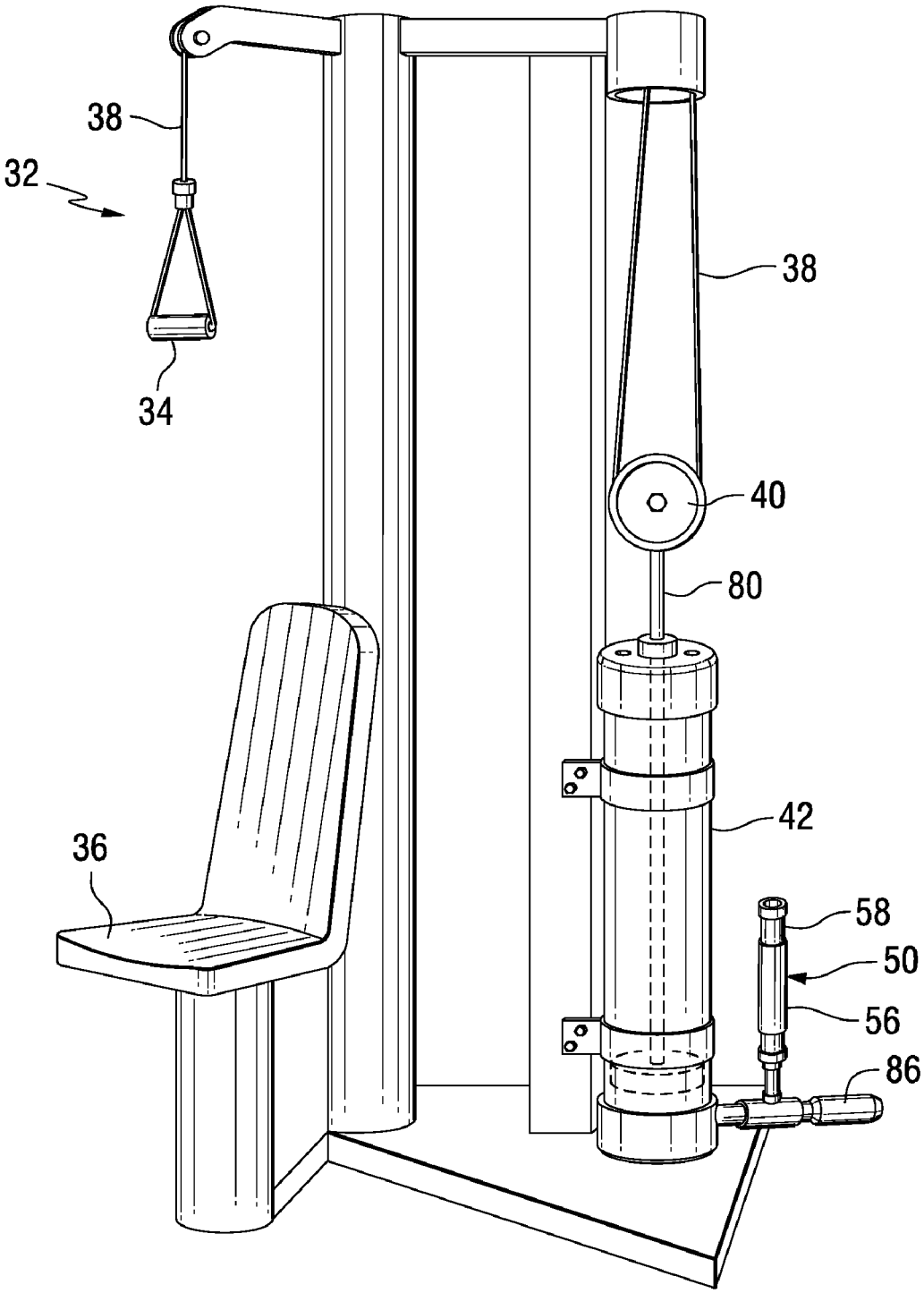
FIG. 2 is a perspective view of further resistance training exercise apparatus in accordance with the invention.
Figure 3:
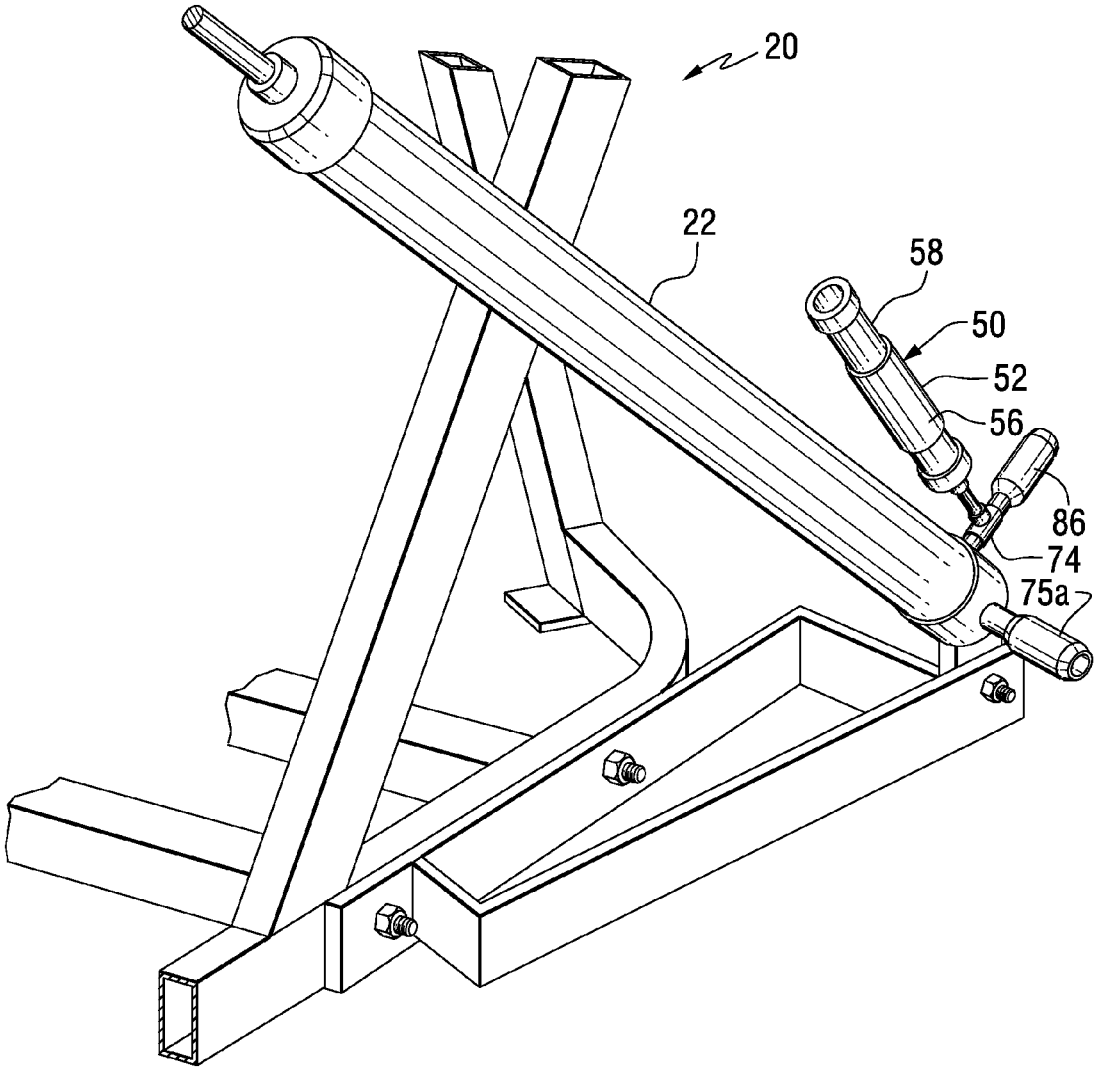
FIG. 3 is an enlarged view of a portion of FIG. 1 and showing a further embodiment.
Figure 4:
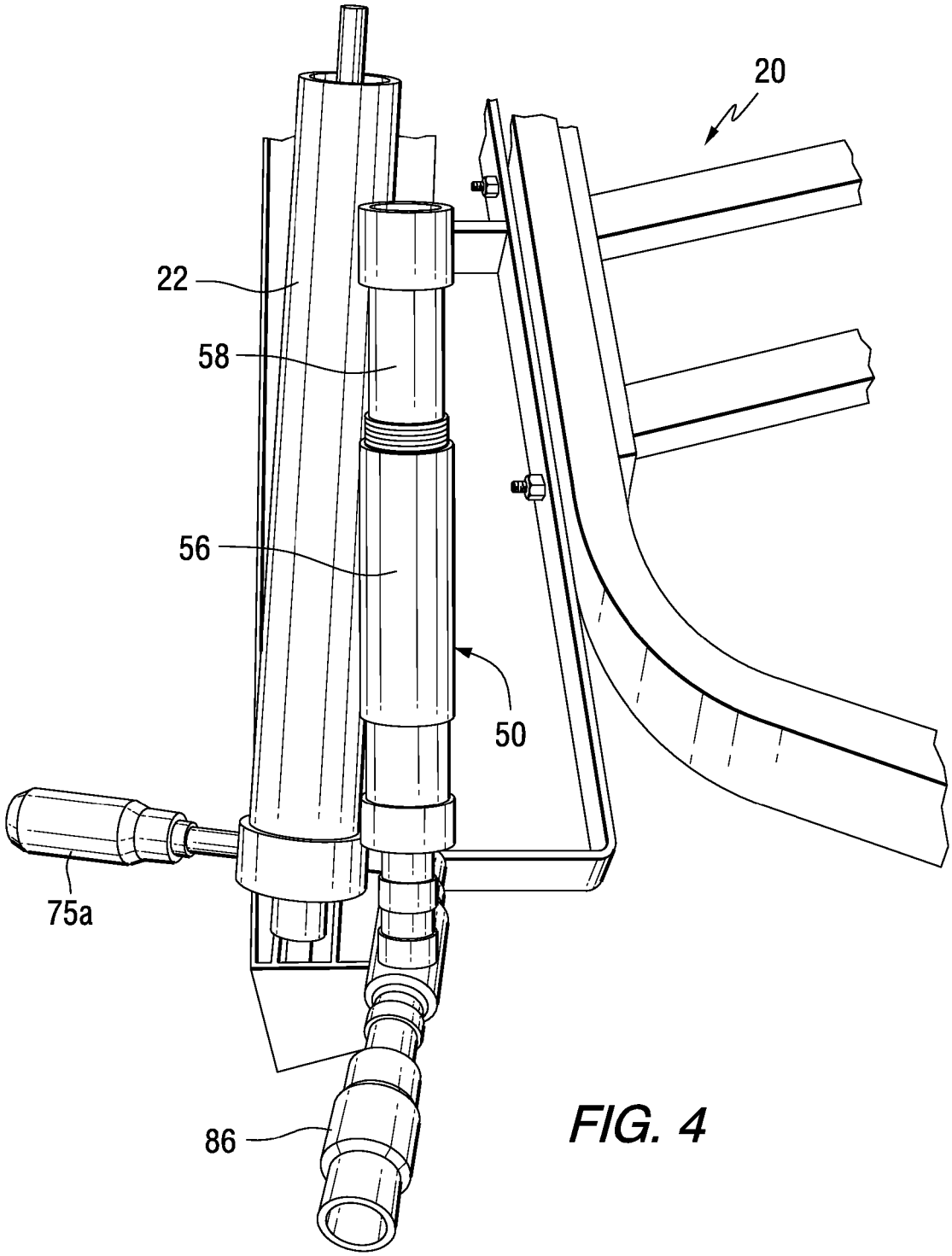
FIG. 4 is view from another angle of the apparatus of FIG. 3.

FIG. 2 shows another application in resistance training exercise apparatus provided by a rope pull system 32 having a handle 34 for engagement by one or both hands of an athlete user seated on seat 36, which handle 34 is pulled downwardly and/or outwardly such that its attached cable 38 pulls pulley 40 upwardly against the resistance of the load system which in the present system is preferably provided by air cylinder 42.

In the present system, the air or other fluid cylinder 22, 42 is part of a load system including a poppet load system. Referring to FIGS. 3-6, poppet load system 50 includes an axially extending tubular housing 52, FIG. 5, having an internal valve seat 54, FIG. 6. The housing includes an outer sleeve 56 circumscribing and receiving an inner sleeve 58 therein in threaded relation and sealed thereto at O-ring 60. Inner sleeve 58 may be turned or rotated about axis 62 to advance further axially leftwardly, in the orientation of FIG. 6, into outer sleeve 56, or to move axially rightwardly outwardly out of outer sleeve 56, for adjustment of load resistance, to be described. Valve seat 54 is at the axially facing left end of inner sleeve 58 in the orientation of FIG. 6. A poppet 64 is axially movable in the housing into and out of engagement with valve seat 54 to closed and open positions, respectively, to block and permit passage of fluid, e.g. air, past poppet 64. FIG. 6 shows poppet 64 in the closed position, engaging valve seat 54. A biasing member 66, e.g. a compression spring, biases poppet 64 into engagement with valve seat 54 to the noted closed position. In the orientation of FIG. 6, biasing spring 66 biases poppet 64 axially rightwardly into engagement with valve seat 54 at the left axial end of inner sleeve 58. The right axial end of spring 66 bears against poppet 64, and the left axial end of spring 66 bears against a thrust bearing 67 in outer sleeve 56, to enable spring 66 and poppet 64 to rotate and not bind during rotational adjustment of inner sleeve 58.

Housing 52, FIG. 6, has first and second chambers 68 and 70 on axially distally opposite sides of poppet 64. A selected one of the first and second chambers, e.g. chamber 68, is fluidly motively coupled to a user-engaged exercise member, for example user-engaged exercise member 24 and/or 26 in FIG. 1 via fluid cylinder 22, or user-engaged exercise member 34 in FIG. 2 via fluid cylinder 42, such that movement of the user-engaged exercise member 24, 26, 34 creates fluid pressure differential across poppet 64, to be described. When the pressure differential overcomes the bias of biasing spring 66, poppet 64 moves out of engagement with valve seat 54, e.g. leftwardly in FIG. 6) to the noted open position permitting fluid flow, e.g. air, past poppet 64 between the first and second chambers, e.g. air flow axially leftwardly in FIG. 6 from chamber 70 to chamber 68, which air continues to flow axially leftwardly through housing port 72 to air passage connecting conduit 74, FIG. 5, to in turn supply air to plenum 76 and relieve the vacuum therein otherwise caused by the upward motion of piston 78 and plunger rod 80 in air cylinder 22 due to the athlete user pushing handles 24, 26 outwardly and upwardly in FIG. 1, or pulling handle 34 downwardly or outwardly in FIG. 2. The air or other fluid in plenum 82 on the other side of piston 78 escapes through vent hole or passage 84.

Figure 5:
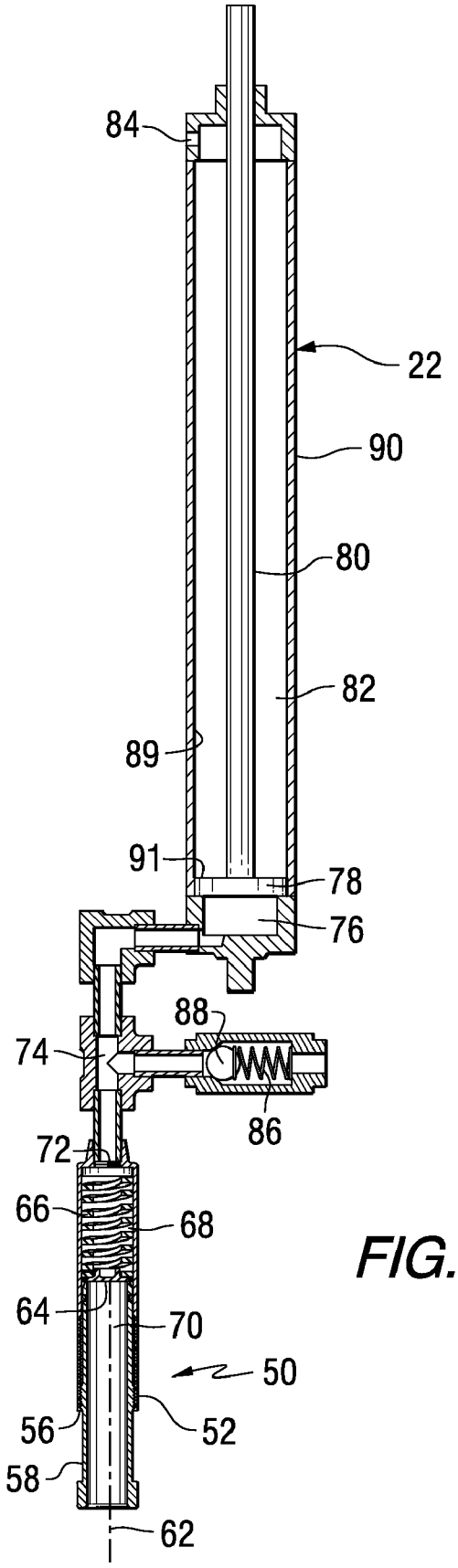
FIG. 5 is a schematic sectional view of a portion of the construction of FIG. 1.
Figure 6:
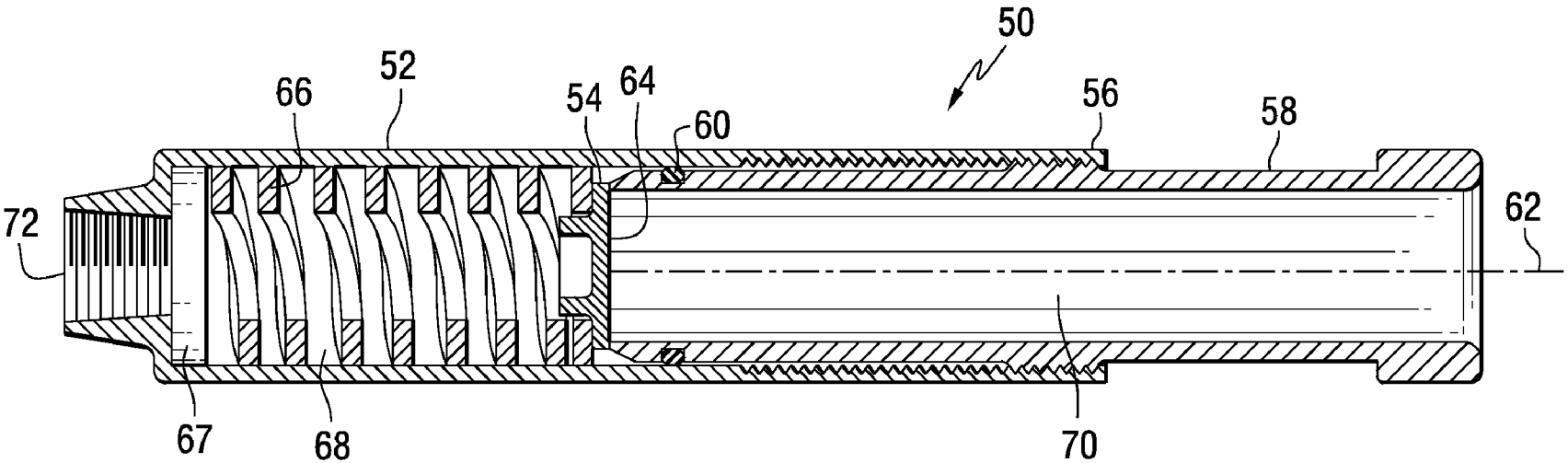
FIG. 6 is an enlarged sectional view of a portion of the construction of FIG. 5.

A given one of the noted chambers 68 and 70, e.g. first chamber 68, has an auxiliary fluid passage 86, FIG. 5, in fluid communication therewith, e.g. through port 72. A one-way valve, e.g. a ball check valve 88, is in auxiliary passage 86 and provides uni-directional fluid flow therethrough. Movement of user-engaged exercise member 24, 26 in a first exercise direction, e.g. upwardly and outwardly in FIG. 1 causes outward extension movement of rod 80 from cylinder 22 which in turn creates vacuum in plenum 76 which vacuum is transferred through transfer passage conduit 74 and port 72 to poppet 64 in chamber 68, and if the vacuum is strong enough to overcome the bias of spring 66 then poppet 64 moves axially leftwardly in FIG. 6 (axially upwardly in FIG. 5) away from valve seat 54 to the noted open position, and fluid such as air flows past the open poppet 64 in a first flow direction (e.g. axially leftwardly in FIG. 6, axially upwardly in FIG. 5) in chamber 68. In this mode, air is blocked from flowing through auxiliary passage 86 by one-way valve 88. During movement of the user-engaged exercise member in a second exercise direction, e.g. downward movement of handles 24, 26 in FIG. 1, e.g. upward movement of handle 34 in FIG. 2, the flow of fluid such as air between first and second chambers 68 and 70, FIG. 6, is blocked by poppet 64 in the noted closed position, and instead the fluid such as air flows through auxiliary passage 86 through one-way valve 88 which allows rightward flow in the orientation of FIG. 5. One-way valve 88 is separate from poppet 64 which in one desirable aspect and embodiment provides simplicity and reliability of construction. In such embodiment, no fluid flows in either direction through poppet 64 in the closed position of the poppet. This is advantageous in such embodiment because it eliminates moving parts in the poppet itself, and the poppet may be provided by a simple disc member.

In the embodiment in FIGS. 1-6, biasing member 66 is in first chamber 68, and first chamber 68 is the noted selected one of the chambers fluidly motively coupled to the user-engaged exercise member, e.g. 24, 26, e.g. 34. One-way valve 88 permits fluid flow through auxiliary passage 86 from connecting passage 74, and blocks flow through auxiliary passage 86 to passage 74. In other embodiments, instead of the vacuum side 68 of the poppet 64 being fluidly motively coupled to the user-engaged exercise member, the pressure side 70 of the poppet may instead be fluidly motively coupled to the user-engaged exercise member, in which case the pressure differential across poppet 64 is caused by positive pressure in chamber 70 rather than negative pressure (vacuum) in chamber 68, e.g. by connecting chamber 70 to the pressure side 82 of an air cylinder piston 78. In such embodiment, biasing member 66 is still provided in first chamber 68, but second chamber 70 is then the noted selected one of the chambers fluidly motively coupled to the user-engaged exercise member, and the noted auxiliary passage is in fluid communication with second chamber 70 and the noted one-way valve permits fluid flow through the auxiliary passage into the noted second chamber or a connecting passage in communication therewith, and blocks fluid flow through the auxiliary passage from the noted second chamber or a connecting passage in communication therewith.

A force transducer, e.g. an air or other fluid cylinder 22, fluidly motively couples the noted selected one of the chambers, e.g. chamber 68, to the noted user-engaged exercise member, e.g. 24, 26, FIG. 1, e.g. 34, FIG. 2. Force transducer 22 in one embodiment is provided by a fluid cylinder housing 90, FIG. 5, having an extensible and retractable plunger rod 80, the rod having a piston 78 in the cylinder and dividing the cylinder into first and second plenums 76 and 82 on distally opposite sides of piston 78. Piston 78 is axially slidable along inner wall 89 of housing 90 and sealed thereto by an annular O-ring or piston ring 91. One of the rod and the cylinder housing is coupled to the user-engaged exercise member, e.g. in FIGS. 1 and 2, rod 80 is coupled to the user-engaged exercise member. One of the first and second plenums, e.g. plenum 76, is in fluid communication with the noted selected one of the chambers, e.g. chamber 68 through connection conduit passage 74.

Figure 7:
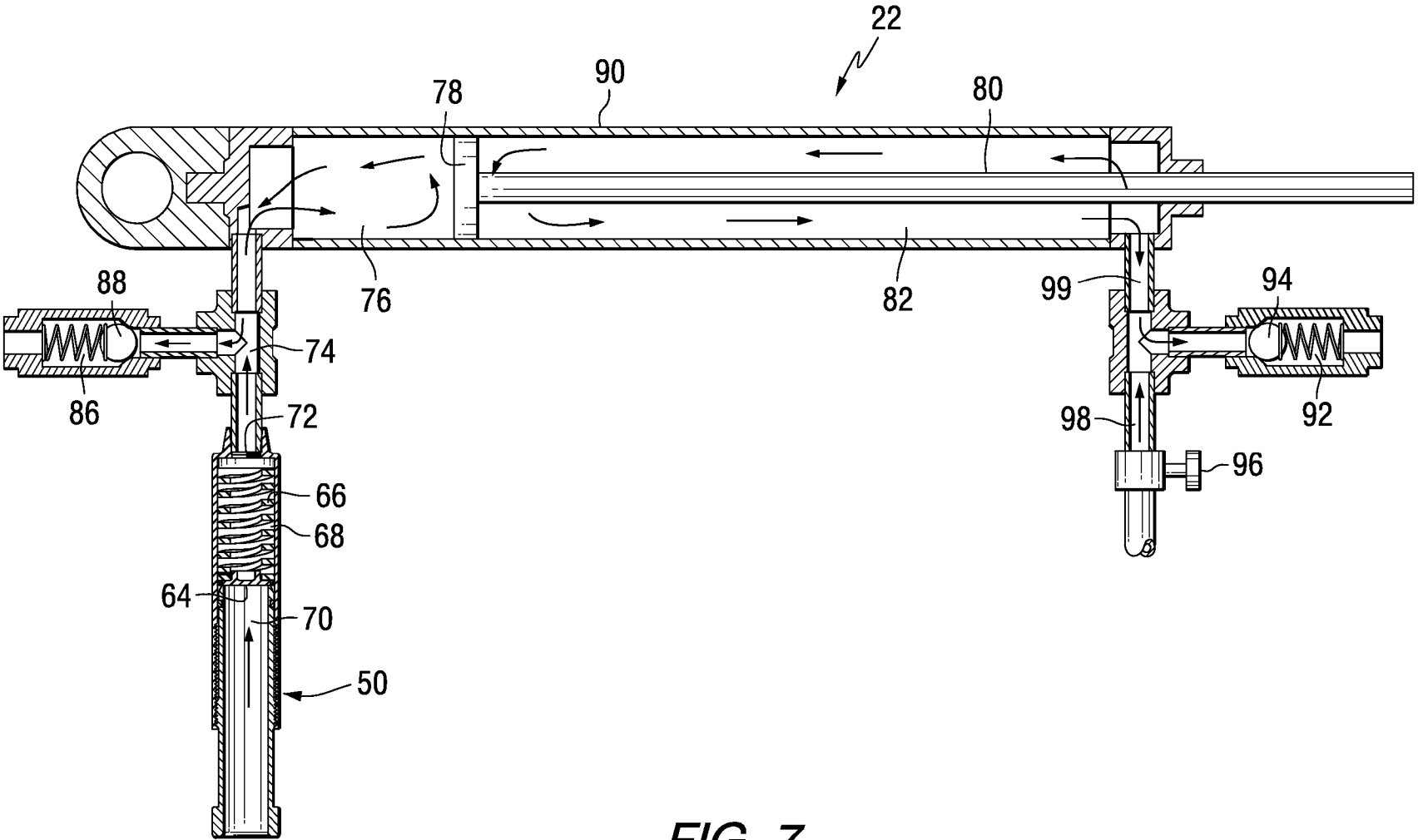
FIG. 7 is enlarged schematic sectional view of a portion of the construction of FIGS. 3, 4.

In one embodiment, FIG. 7, a second auxiliary fluid passage 92 is provided in fluid communication with the other of the noted plenums, e.g. plenum 82. A second one-way valve 94 is provided in second auxiliary passage 92 and provides uni-directional fluid flow therethrough to permit movement of piston 78 and rod 80 in a first piston direction, e.g. rightwardly in FIG. 7, enabling the user-engaged exercise member to move in a first exercise direction, e.g. upward and outward movement of user-engaged exercise member 24, 26 in FIG. 1, e.g. downward movement of user-engaged exercise member 34 in FIG. 2, and preventing movement of piston 78 and rod 80 in a second opposite piston direction, e.g. leftwardly in FIG. 7, even though the noted first one-way valve 88 would otherwise permit such movement. This provides the above-noted ballistic training mode, when desired, stopping and holding the user-engaged exercise member at its far travel point as thrown or shoved by the athlete user, preventing return movement, so that the athlete or trainer can measure how far the member traveled. A release valve 96 is provided in a release passage 98 in fluid communication with the noted other plenum 82 and is actuatable to an open condition to enable fluid flow therebetween to enable, for example, air to flow through passage 98 into plenum 82 to relieve the vacuum therein otherwise caused by closed one-way valve 94, to thus enable leftward movement of piston 78 and rod 80 in FIG. 7, to in turn enable return movement of the user-engaged exercise member, e.g. downward movement of user-engaged exercise member 24, 26 in FIG. 1, e.g. upward movement of user-engaged exercise member 34 in FIG. 2.

Figure 8:
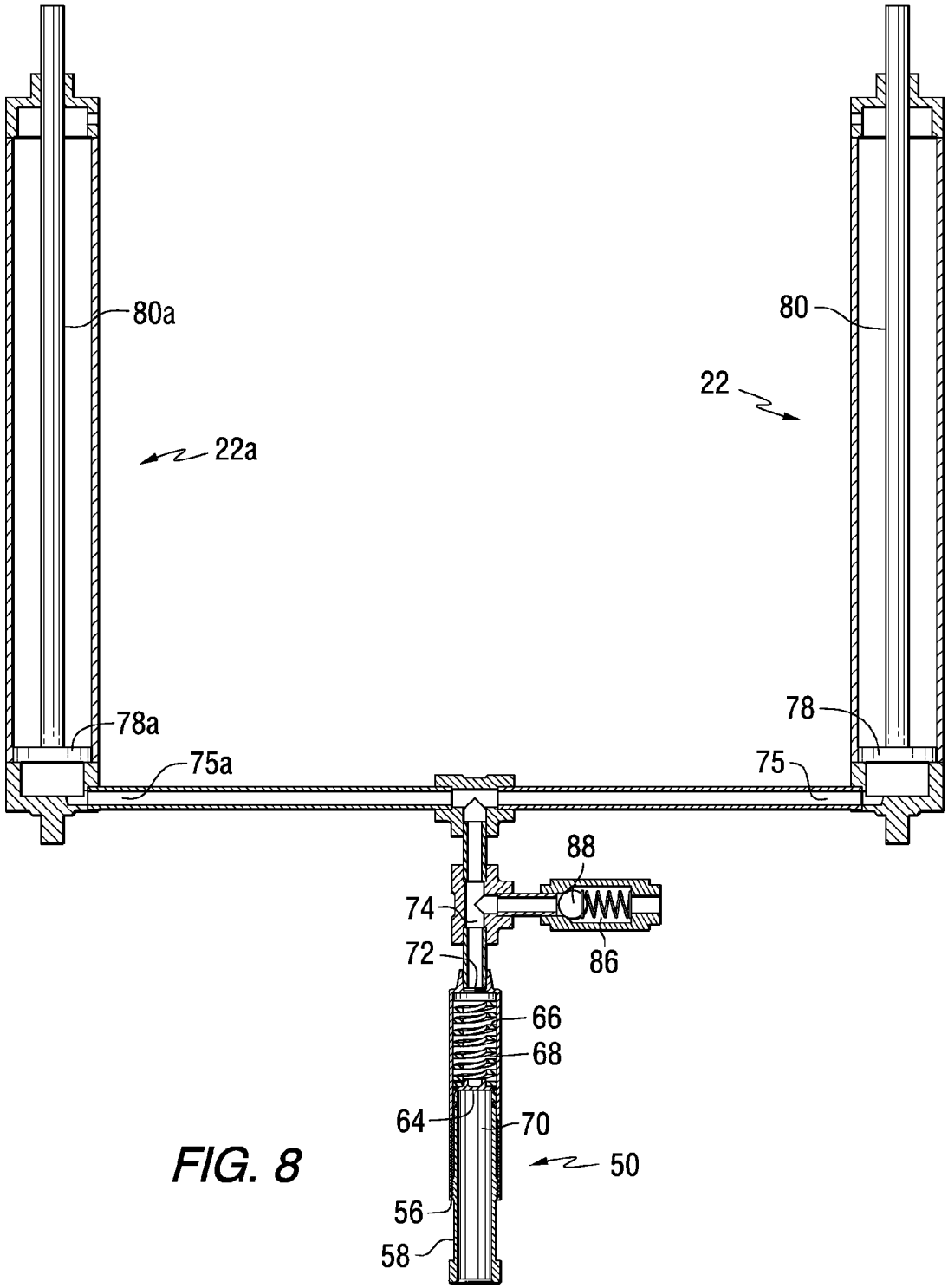
FIG. 8 is like FIG. 5 and shows a further embodiment.

FIG. 8 is like FIG. 5 and shows a further embodiment wherein poppet load system 50 services two force transducer fluid cylinders 22 and 22*a*, at respective connecting conduit passages 75 and 75*a*, and each having a respective piston 78, 78*a* and rod 80, 80*a*. In such embodiment, rod 80 may be coupled to user-engaged exercise member 26 of FIG. 1, and rod 80*a* connected to user-engaged exercise member 24.

Figure 9:
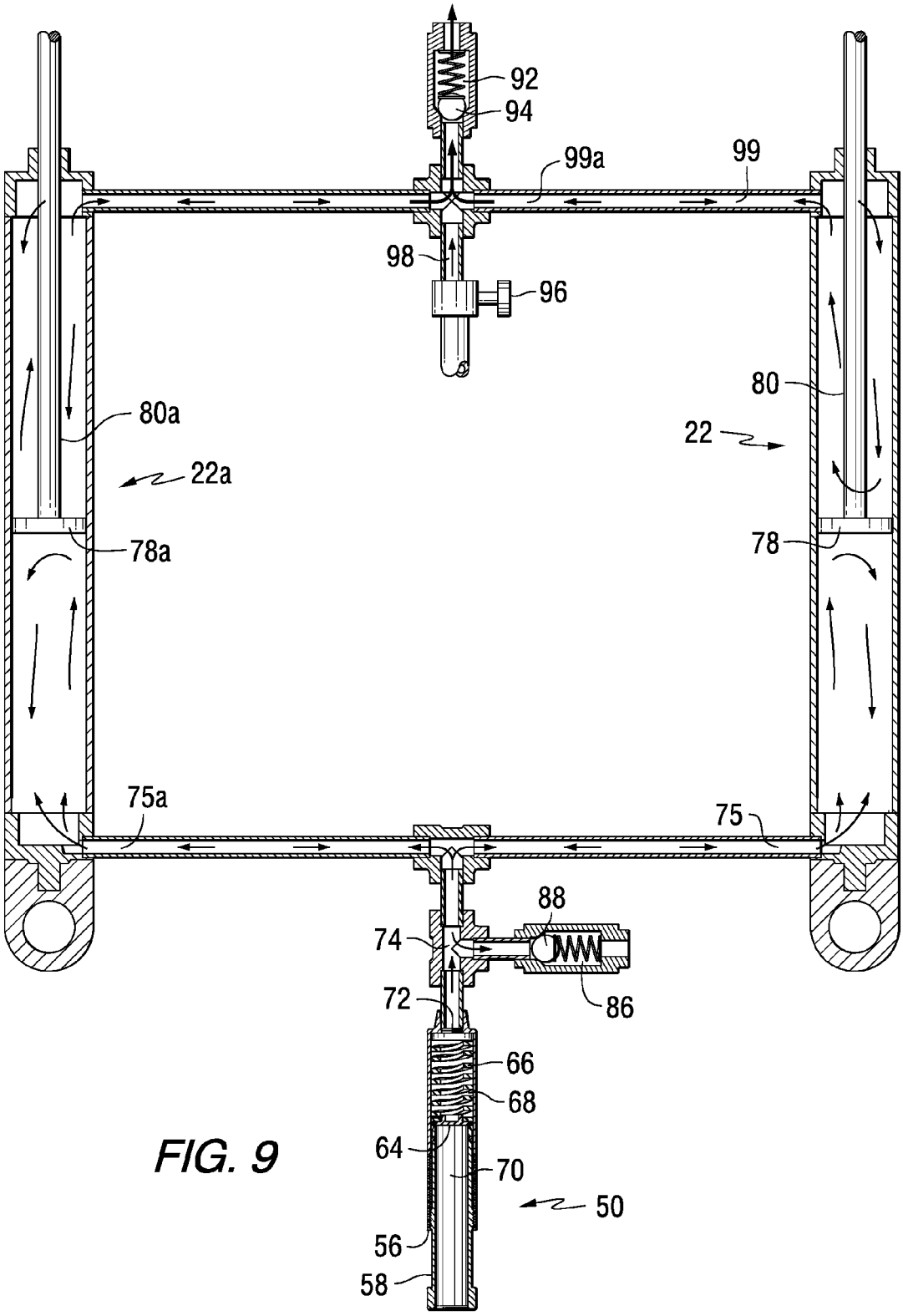
FIG. 9 is like FIG. 8 and shows a further embodiment.

FIG. 9 is like FIG. 8 and shows a further embodiment. The noted second one-way valve 94 of FIG. 7 and release valve 96 service both of fluid cylinders 22 and 22*a* at respective conduit connection passages 99 and 99*a*.

When the noted poppet load system is used on the vacuum side of the air cylinder, the maximum load per cylinder is determined by the surface area of the piston in the cylinder times the atmospheric pressure (14.7 pounds per square inch, psi) times the total number of cylinders. For example, if a three-inch diameter piston 78 is used, the maximum load would be the surface area of the piston times 14.7 psi, thus 104 pounds of potential load for one such cylinder. A single poppet valve could be used in parallel with two or more cylinders to obtain higher loads, e.g. FIG. 9. In one embodiment, for a piston area of 0.78 square inches, the maximum load for one cylinder is 11.54 pounds, and the maximum load for two cylinders is 23.09 pounds. In another embodiment, for a piston area of 3.14 square inches, the maximum load for one cylinder is 46.18 pounds, and the maximum load for two cylinders is 92.36 pounds. In another embodiment, for a piston area of 7.06 square inches, the maximum load for one cylinder is 103.91 pounds, and the maximum load for two cylinders is 207.82 pounds. In another embodiment, for a piston area of 12.57 square inches, the maximum load for one cylinder is 184.72 pounds, and the maximum load for two cylinders is 369.45 pounds. In another embodiment, for a piston area of 19.63 square inches, the maximum load for one cylinder is 288.63 pounds, and the maximum load for two cylinders is 577.27 pounds. In another embodiment, for a piston area of 28.27 square inches, the maximum load for one cylinder is 415.63 pounds, and the maximum load for two cylinders is 831.26 pounds. In another embodiment, for a piston area of 38.48 square inches, the maximum load for one cylinder is 565.72 pounds and the maximum load for two cylinders is 1,131.44 pounds. In another embodiment, for a piston area of 50.26 square inches, the maximum load for one cylinder is 738.90 pounds, and the maximum load for two cylinders is 1,477.80 pounds.

Figure 10:
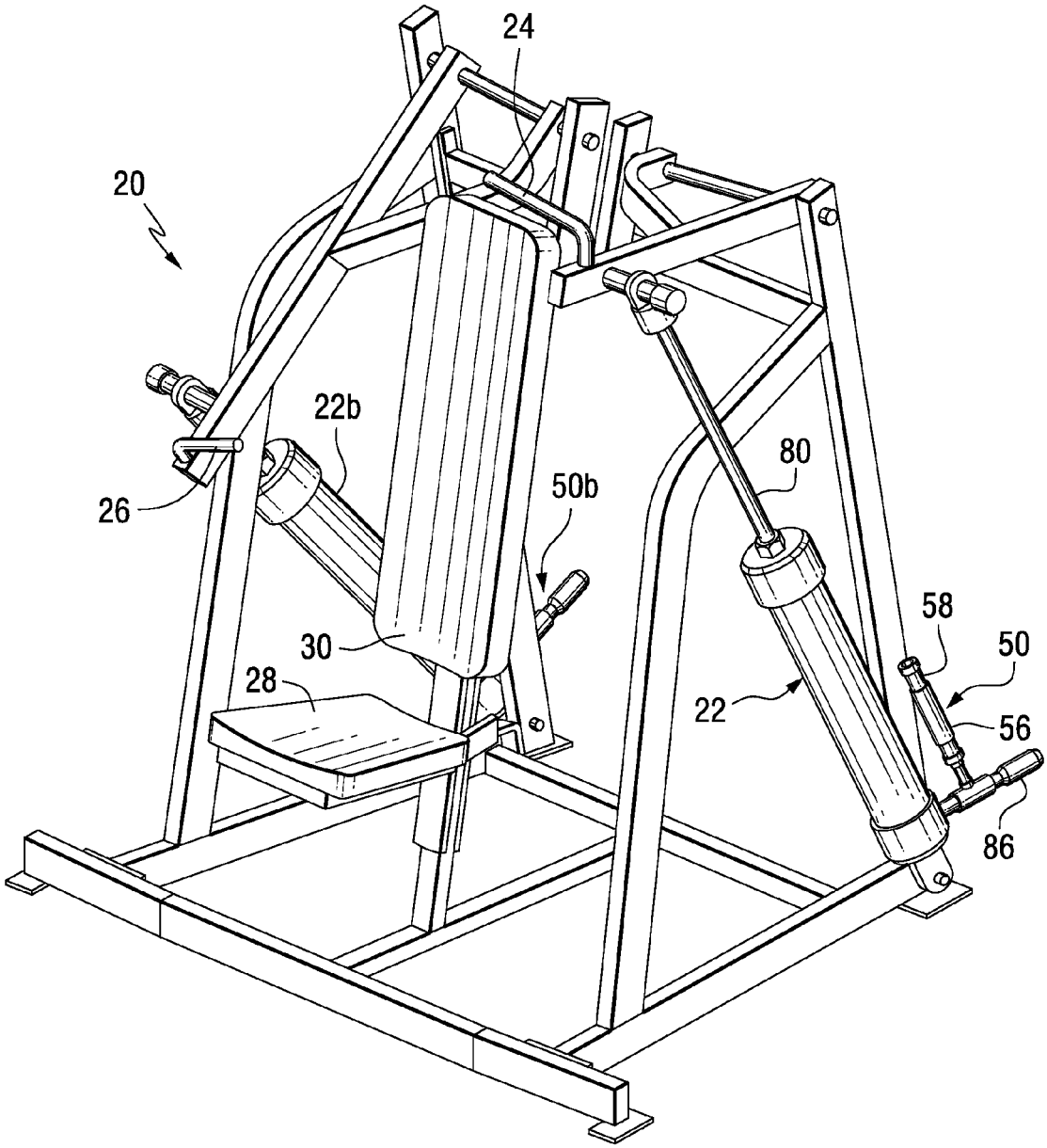
FIG. 10 is like FIG. 1 and shows a further embodiment.

FIG. 10 is like FIG. 1 and shows a further embodiment, and uses like reference numerals from FIG. 1 where appropriate to facilitate understanding. A second separate force transducer fluid cylinder 22*b* provides resistance resisting upward and outward movement of user-engaged right hand exercise member 26. Force transducer fluid cylinder 22 provides resistance resisting upward and outward movement of user-engaged left hand exercise member 24. Force transducer fluid cylinders 22*b* and 22 provide separate, independent control of the resistance of right hand and left hand exercise members 26 and 24. Force transducer fluid cylinders 22*b* and 22 have their own respective individual independently controlled poppet load systems 50*b* and 50 respectively.

In the foregoing description, certain terms have been used for brevity, clearness, and understanding. No unnecessary limitations are to be inferred therefrom beyond the requirement of the prior art because such terms are used for descriptive purposes and are intended to be broadly construed. The different configurations, systems, and method steps described herein may be used alone or in combination with other configurations, systems and method steps. It is to be expected that various equivalents, alternatives and modifications are possible within the scope of the appended claims.

What is claimed is:

1. Resistance training apparatus comprising a load system for providing resistance comprising an axially extending tubular housing having a valve seat therein, a poppet axially movable in said housing into and out of engagement with said valve seat to closed and open positions, respectively, to block and permit passage of fluid past said poppet, a biasing member biasing said poppet into engagement with said valve seat to said closed position, said tubular housing having first and second chambers on axially distally opposite sides of said poppet, a selected one of said first and second chambers being fluidly motively coupled to a user-engaged exercise member such that movement of said user-engaged exercise member creates fluid pressure differential across said poppet, and when said pressure differential overcomes the bias of said biasing member, said poppet moves out of engagement with said valve seat to said open position permitting fluid flow past said poppet between said first and second chambers, an auxiliary fluid passage in fluid communication with a given one of said chambers, a one-way valve in said auxiliary passage providing uni-directional fluid flow therethrough, such that during movement of said user-engaged exercise member in a first exercise direction, fluid flows past an open said poppet and in a first flow direction in said given one of said chambers and is blocked from flowing through said auxiliary passage by said one-way valve, and such that during movement of said user-engaged exercise member in a second exercise direction, fluid between said first and second chambers is blocked by a closed said poppet and flows through said auxiliary passage through said one-way valve.

2. The resistance training exercise apparatus according to claim 1 wherein:

said biasing member is in said first chamber;

said first chamber is said selected one of said chambers fluidly motively coupled to said user-engaged exercise member;

said auxiliary passage is in fluid communication with said first chamber through a connecting passage;

said one-way valve permits fluid flow through said auxiliary passage from said connecting passage, and blocks fluid flow through said auxiliary passage to said connecting passage.

3. The resistance training exercise apparatus according to claim 1 comprising a force transducer fluidly and motively coupling said selected one of said chambers to said user-engaged exercise member, said force transducer comprising a fluid cylinder housing having an extensible and retractable plunger rod, said rod having a piston in said cylinder and dividing said cylinder into first and second plenums on distally opposite sides of said piston, one of said rod and said cylinder housing being coupled to said user-engaged exercise member, one of said first and second plenums being in fluid communication with said selected one of said chambers.

4. The resistance training exercise apparatus according to claim 3 comprising:

a second auxiliary fluid passage in fluid communication with the other of said plenums;

a second one-way valve in said second auxiliary passage providing uni-directional fluid flow therethrough to permit movement of said piston and said rod in a first piston direction enabling said user-engaged exercise member to move in said first exercise direction, and preventing movement of said piston and said rod in a second opposite piston direction;

a release valve in fluid communication with said other plenum and actuatable to enable fluid flow therebetween to enable movement of said piston and said rod independently of and regardless of fluid flow through said second one-way valve.

5. The resistance training exercise apparatus according to claim 1 wherein said selected one of said first and second chambers is said given one of said chambers.

6. The resistance training exercise apparatus according to claim 1 wherein said one-way valve is separate from said poppet, and wherein no fluid flows in either direction through said poppet in said closed position of said poppet.

7. Resistance training exercise apparatus comprising a load system for providing resistance comprising an axially extending tubular housing having a valve seat therein, a poppet axially movable in said housing into and out of engagement with said valve seat to closed and open positions, respectively, to block and permit passage of fluid past said poppet, a biasing member biasing said poppet into engagement with said valve seat to said closed position, said tubular housing having first and second chambers on axially distally opposite sides of said poppet, a selected one of said first and second chambers being fluidly motively coupled to a user-engaged exercise member such that movement of said user-engaged exercise member creates fluid pressure differential across said poppet, and when said pressure differential overcomes the bias of said biasing member, said poppet moves out of engagement with said valve seat to said open position permitting fluid flow past said poppet between said first and second chambers, an auxiliary fluid passage in fluid communication with a given one of said chambers, a one-way valve in said auxiliary passage providing uni-directional fluid flow therethrough, such that during movement of said user-engaged exercise member in a first exercise direction, fluid flows past an open said poppet and in a first flow direction in said given one of said chambers and is blocked from flowing through said auxiliary passage by said one-way valve, and such that during movement of said user-engaged exercise member in a second exercise direction, fluid between said first and second chambers is blocked by a closed said poppet and flows through said auxiliary passage through said one-way valve, wherein:

said biasing member is in said first chamber;

said first chamber is said selected one of said chambers fluidly motively coupled to said user-engaged exercise member;

said auxiliary passage is in fluid communication with said first chamber through a connecting passage;

said one-way valve permits fluid flow through said auxiliary passage from said connecting passage, and blocks fluid flow through said auxiliary passage to said connecting passage, and comprising:

a force transducer fluidly and motively coupling said selected one of said chambers to said user-engaged exercise member, said force transducer comprising a fluid cylinder having an extensible and retractable plunger rod, said rod having a piston in said cylinder and dividing said cylinder into first and second plenums on distally opposite sides of said piston, one of said rod and said cylinder housing being coupled to said user-engaged exercise member, one of said first and second plenums being in fluid communication with said selected one of said chambers;

a second auxiliary fluid passage in fluid communication with the other of said plenums;

a second one-way valve in said second auxiliary passage providing uni-directional fluid flow therethrough to permit movement of said piston and said rod in a first piston direction enabling said user-engaged exercise member to move in said first exercise direction, and preventing movement of said piston and said rod in a second opposite piston direction;

a release valve in fluid communication with said other plenum and actuatable to enable fluid flow therebetween to enable movement of said piston and said rod independently of and regardless of fluid flow through said second one-way valve.

* * * * *